United States Patent [19]

Kindig et al.

[11] 4,120,665

[45] Oct. 17, 1978

[54] PROCESS FOR IMPROVING COAL

[75] Inventors: James K. Kindig, Arvada; Ronald L. Turner, Golden, both of Colo.

[73] Assignee: Hazen Research, Inc., Golden, Colo.

[21] Appl. No.: 761,307

[22] Filed: Jan. 21, 1977

[51] Int. Cl.[2] ..... C10L 9/10; C10B 57/00

[52] U.S. Cl. ..... 44/1 R; 201/17

[58] Field of Search ..... 44/1 R; 201/17

[56] References Cited

U.S. PATENT DOCUMENTS

| | | | |
|---|---|---|---|
| 2,726,148 | 12/1955 | McKinley et al. | 44/1 R |
| 2,793,172 | 5/1957 | Smith et al. | 201/17 X |
| 3,595,965 | 7/1971 | Franz et al. | 201/17 X |
| 3,938,966 | 2/1976 | Kindig et al. | 44/1 R |
| 4,052,170 | 10/1977 | Yan | 44/1 R |

*Primary Examiner*—Carl Dees

*Attorney, Agent, or Firm*—Sheridan, Ross, Fields & McIntosh

[57] ABSTRACT

In a process for improving coal wherein the raw coal is treated with a metal containing compound in order to enhance the magnetic susceptibility of certain impurity components contained in the raw coal permitting their removal by magnetic separation, the improvement comprising pretreating the coal by heating it to at least a temperature for at least a period of time sufficient to essentially meet or exceed a time and temperature relationship expressed as:

$$D \geqq K[50/T-90]^3$$

wherein $D$ is time in hours and $T$ is temperature in degrees Celsius, and wherein $K$ is preferably at least about 0.5, more preferably at least about 5, and most preferably at least about 25.

42 Claims, No Drawings

PROCESS FOR IMPROVING COAL

BACKGROUND OF THE INVENTION

1. Field of the Invention

The process of the present invention relates to the improvement of the properties of coal, and is classified generally in class 44 relating to fuels and igniting devices.

2. The Prior Art

With the present world-wide emphasis on the energy crisis and the rapidly diminishing sources of oil, increased attention by both government and private organizations is being given to coal as a source of energy, especially for the generation of electricity. This country has vast resources of coal for development as other sources of energy diminish.

Depending upon their origin, coals contain varying amounts of iron disulfide (iron disulfide is hereinafter referred to as pyrite whether crystallized as pyrite or marcasite) from which sulfur dioxide is formed as a combustion product when coal is burned. This is a tremendous disadvantage to the use of coal as an energy source, particularly in view of the present emphasis on pollution controls as illustrated by present federal emission control standards for sulfur dioxide. Illustrating the enormity of the sulfur dioxide emission problem is the fact that large transportation expenses are incurred by coal users in transporting Western and European coal of relatively low sulfur content long distance to supplant available high sulfur-containing coals in order to comply with sulfur dioxide emission standards. At this time, there are no effective means available which are commercially feasible for absorbing the large amounts of sulfur dioxide emitted by the combustion of coal to produce heat and electricity. One solution to the problem is to separate the sulfur-bearing pyrite from the coal before it is burned.

Coals also contain, depending upon their origin, various amounts and kinds of minerals which form ash when the coal is burned. The ash also is a disadvantage to the use of coal as an energy source, since it contributes no energy value during combustion. The ash causes a dilution of the calorific value of the coal, and causes a waste disposal problem and a potential air pollution problem.

The problem of separating pyrite or other impurities from raw coal is not new and a number of methods have been extensively tested over the years. Among these are methods which employ the difference in specific gravity between coal particles and the impurity particles or differences in their surface, electrostatic, chemical, or magnetic properties. For various reasons, difficulties are encountered in making an efficient separation of pyrite or other impurities from coal which has been ground fine enough to substantially liberate impurity particles from coal particles. In water systems this difficulty is related to the slow settling rate of fine particles, and in air systems to the large difference in specific gravity between air and the particles. However, for magnetic separations the magnetic attraction force acting on small magnetic particles is many times greater than the opposing separating force, which is usually a hydraulic drag and/or gravity force.

For the separation of pyrite or other impurities from raw coal the success of a magnetic process is dependent upon some effective pretreatment process for selectively enhancing the magnetic susceptibility of the pyrite or impurity particles. Coal particles alone are slightly diamagnetic while pyrite and many other mineral impurities are weakly paramagnetic; however, their paramagnetism has not been sufficient to economically effect a separation from coal. However, effective beneficiation of coals can be made if the magnetic susceptibility of pyrite or other impurities is increased. For pyrite it has been estimated that a sufficient increase in susceptibility can be achieved by converting less than 0.1 percent of pyrite in pyritic coal into ferromagnetic compounds of iron. ("Magnetic Separation of Pyrite from Coals," Bureau of Mines Report of Investigations 7181, P.1.)

In discussing the use of heat to enhance the paramagnetism of pyrite it is stated in the above report (P.1) that ferromagnetic compounds of iron are not formed in significant quantities at temperatures below 400° C., and that such conversion occurs in sufficient quantities to effect beneficiation only at temperatures greater than 500° C. As this is above the decomposition temperature of coal, the use of heat to enhance the magnetic susceptibility of impurities does not appear feasible. Further, other methods for enhancing the paramagnetism of pyrite to permit its separation from coal have not been encouraging.

U.S. Pat. No. 3,938,966 discloses a process for improving coal wherein the raw coal is reacted with substantially undecomposed iron carbonyl which alters the apparent magnetic susceptibility of certain impurity components contained in the raw coal, thereby permitting their removal by low-intensity magnetic separators. This process represents a noteworthy advance in the art, as treating coal in accordance with this process may substantially remove impurities such as pyrite, a primary contributor to sulfur dioxide pollution problems. The process of this patent, however, does not appear to possess universal applicability with an equal degree of success in that while many coals are substantially enhanced by this treatment, certain other coals are not as receptive. It has been discovered by the inventors of the present application that pretreating coal with heat under various conditions as hereinafter presented substantially enhances the effectiveness of the process of this patent. The process of the present invention therefore constitutes in part an improvement of the process described in U.S. Pat. No. 3,938,966, in accordance with the discussion presented hereinafter.

SUMMARY OF THE INVENTION

The process of the present invention entails initially heating raw coal to at least a temperature for at least a period of time sufficient to essentially meet or exceed a time and temperature relationship expressed as:

$$D \geqq K(50/T-90)^3$$

wherein $D$ is time in hours and $T$ is temperature in degrees Celsius, and wherein $K$ is preferably at least about 0.5, more preferably at least about 5, and most preferably at least about 25, and then treating the raw coal with a metal containing compound in order to enhance the magnetic susceptibility of certain impurities contained in the raw coal, thereby permitting their removal by magnetic means.

DESCRIPTION OF THE PREFERRED EMBODIMENT

The process of the present invention can be applied to coals of universal origin, as long as the coal contains one or more impurities receptive to the metal treatment. The basic process employs a metal treatment in order to enhance the magnetic susceptibility of an impurity. By selectively enhancing this property of the impurity, while not affecting the coal itself, a magnetic separation may be conventionally accomplished to remove the impurity from the coal. The coal is therefore left in a more pure state, rendering it more suitable for combustion.

"Enhancing the magnetic susceptibility" of a particle of an impurity as used herein is intended to be defined in accordance with the following discussion. Every compound of any type has a specifically defined magnetic susceptibility, which refers to the overall attraction of the compound to a magnetic force. An alteration of the surface characteristics will alter the magnetic susceptibility. The metal treatment of the basic process alters the surface characteristics of an impurity in order to enhance the magnetic susceptibility of the impurity. It is to be understood that the magnetic susceptibility of the impurity is not actually changed, but the particle itself is changed, at least at its surface, resulting in a particle possessing a greater magnetic susceptibility than the original impurity. For convenience of discussion, this alteration is termed herein as "enhancing the magnetic susceptibility" of the particle or impurity itself.

The impurities with which the process of the present invention may be utilized include those impurities which react with one or more of the metal compounds hereinafter described to form a product possessing an enhanced magnetic susceptibility. Examples of such impurities include pyrite; ash-forming minerals, such as clays and shales; and various sulfates, for example, calcium sulfate and iron sulfate. For purposes of illustration the discussion hereinafter refers to pyrite, but it is to be understood that other suitable impurities may be affected in similar fashion.

Numerous metal containing compounds are suitable to impart this magnetic susceptibility. A number of different mechanisms are believed to be involved in what is termed herein as the "treatment" and/or magnetic susceptibility enhancement "reaction" depending upon the metal containing compound or compounds and the reaction conditions employed. Some metal containing compounds, with metals more magnetic than the impurities, principally iron, under certain conditions coat the impurity with the metal, thereby enhancing the magnetic susceptibility of the impurity. Some metal containing compounds affect the pyrite by combining with some of the pyrite sulfur to yield an iron sulfide more magnetic than pyrite. The following reaction exemplifies this mechanism:

$$6M + 7FeS_2 \rightarrow Fe_7S_8 + 6MS$$

Similarly components of ash, such as $Fe_2O_3$, may react with a metal to form a more strongly magnetic compound, as for example, in accordance with the following reaction:

$$M + 3Fe_2O_3 \rightarrow MO + 2Fe_3O_4$$

In similar fashion, U.S. Pat. No. 3,938,966 and the reaction mechanisms illustrated therein with respect to pyrite and iron pentacarbonyl present viable techniques for enhancing the magnetic susceptibilities of impurities.

Other mechanisms undoubtedly also contribute to the enhancing of the magnetic susceptibility, and again this is principally determined by the particular metal containing compound or compounds employed and the reaction conditions. It is to be understood that in view of the disclosures herein presented, the selection of a given metal compound, along with the most desirable reaction conditions to be employed with the given compound, cannot be itemized for each and every compound due to the number of variables involved. However, the proper selection will be apparent to one skilled in the art with but a minimal amount of experimentation, and it is sufficient to note that the improvement of the invention herein set forth relates to all of these compounds.

Many organic iron containing compounds possess the capability of enhancing the magnetic susceptibility of coal impurities, as long as the compound is adaptable so as to bring the iron in the compound into contact with the impurity under conditions such as to cause an alteration of at least a portion of the surface of the impurity. Organic iron containing compounds capable of exerting sufficient vapor pressure, with iron as a component in the vapor so as to bring the iron into contact with the impurity at the reaction temperature are suitable, as well as other organic iron containing compounds which can be dissolved and/or "dusted" and brought into contact with the impurity.

Preferred compounds within the vapor pressure group are those which exert a vapor pressure, with iron as a component in the vapor, of at least about 10 millimeters of mercury, more preferably at least about 25 millimeters of mercury, and most preferably at least about 50 millimeters of mercury at the reaction temperature. Examples of groupings which fall within this vapor pressure definition include ferrocene and its derivatives and beta-diketone compounds of iron. Specific examples include ferrocene, dimethyl ferrocenedioate, 1,1'-ferrocenedicarboxylic acid, ferric acetylacetonate, and ferrous acetylacetonate.

Other organic compounds which may be utilized to enhance the magnetic susceptibility include those which may be dissolved and brought into contact with the impurities. These compounds must have sufficient solubility so as to provide sufficient metal to contact the surface of the impurity. Preferably the solubility is at least about 1 grams per liter, more preferably at least about 10 grams per liter, and most preferably at least about 50 grams per liter at injection temperature. The solvent must, of course, possess the above capabilities, and preferably not create side reaction problems tending to detract from the effectiveness of the process. Suitable solvents include, for example, acetone, petroleum ether, naphtha, hexane, and benzene. This is, of course, dependent upon the particular metal compound being employed.

A grouping which falls within this solution definition includes the carboxylic acid salts of iron; and specific examples include iron octoate, iron naphthenate and iron stearate.

Various inorganic compounds are also capable of producing an enhanced magnetic susceptibility. Preferred inorganic compounds include metal carbonyls, including, for example, iron, nickel, cobalt, molybdenum, tungsten, and chromium carbonyls and derivatives of these compounds. Iron carbonyl is a preferred carbonyl for imparting this magnetic susceptibility, particularly iron pentacarbonyl, iron dodecacarbonyl, and iron nonacarbonyl.

The most preferred metal containing compound capable of enhancing the magnetic susceptibility is iron pentacarbonyl. The process is applied by contacting the raw coal which is liberated from pyrite or other impurities with iron carbonyl under conditions such that there is an insufficient dissociation of carbonyl into metal and carbon monoxide to cause substantial deposition of metal on the coal particles. These conditions are determined by the temperature, the type of carbonyl, pressure, gas composition, etc. Ordinarily, the carbonyl gas is heated to a temperature just below its decomposition temperature under the reaction conditions. Various types of available equipment can be used for contacting the iron carbonyl and coal, such as, a rotating kiln used as the reaction vessel with iron carbonyl vapors carried into contact with the tumbling contents of the kiln by a gas such as nitrogen.

When carbonyl is used as the magnetic susceptibility enhancement reactant, the process must be carried out at a temperature below the temperature of major decomposition of the carbonyl under the reaction conditions so that there is opportunity for the iron of the carbonyl to chemically react with the pyrite particles. If the temperature is allowed to rise above the decomposition temperature, the selectivity of the process of enhancing the magnetic susceptibility of one or more impurities without affecting the coal is impaired.

Most preferably the iron pentacarbonyl treatment is performed by contacting the coal with the carbonyl for a time of from about one-half to about four hours at a temperature of from about 150° to about 200° C. and a carbonyl concentration of from about 4 to about 32 pounds per ton of coal.

For efficient separations of pyrite from coal, the coal should be crushed to such fineness that pyrite particles are free, or nearly free, from the coal particles. The required fineness depends upon the size distribution of the pyrite in the coal. A thorough treatment of the subject for power plant coals is given in the article entitled "Pyrite Size Distribution and Coal-Pyrite Particle Association in Steam Coals," Bureau of Mines Report of Investigation 7231. The requirement for pyrite liberation applies to all types of physical separations and so is not a disadvantage of this invention. Additionally, present technology for coal-fired power plants generally requires pulverizing the coal to 60–90 percent minus 200 mesh before burning.

The improvement to which the process of the present invention is directed comprises pretreating the raw coal prior to initiating the reaction with the metal containing compound.

This pretreatment essentially comprises heating the coal in order to render the coal and impurities more receptive to the magnetic enhancement reaction. The temperature and time of heating are interrelated, and essentially higher temperatures require less time. It is essentially preferred that the temperature and time be selected in accordance with the following equation:

$$D \geqq K(50/T-90)^3$$

wherein $D$ is time in hours and $T$ is temperature in degrees Celsius, and wherein $K$ is preferably at least about 0.5, more preferably at least about 5, and most preferably at least about 25. The equation is not accurate with respect to temperatures less than about 95° C. Some improvement may be realized at temperatures below 95° C., but the time requirement would be inordinate. Under circumstances when the temperature exceeds the combustion temperature of coal the time must be very short in order to prevent combustion, and preferably not substantially exceeding the value of the equation. Additionally, other precautions known to the art should be complied with.

While operating within the above time-temperature equation it is generally preferred that the pretreatment essentially comprise heating the coal to a temperature of at least about 100° C., more preferably to a temperature of at least about 150° C., and most preferably to a temperature of at least about 170° C. This heat pretreatment is preferably for at least about 1 hour, and more preferably for at least about 2 hours.

The heat pretreatment need not be immediately followed by the magnetic enhancement reaction. Hence the coal may be permitted to cool down to ambient temperature, or any other convenient temperature, prior to conducting the magnetic susceptibility enhancement reaction.

It is generally preferred to maintain the heat pretreatment temperature at least slightly above the temperature of the magnetic enhancement reaction. This is not an imperative requirement; however, improved results are generally accomplished. The pretreating by heating the coal is believed to volatilize various components which can interfere with the magnetic enhancement reaction. Hence, if the magnetic enhancement reaction is conducted at a temperature in excess of the pretreatment temperature, it is possible that additional volatile components could somewhat detrimentally affect the magnetic enhancement reaction.

The heat pretreatment step may be conducted in the presence of one or more gaseous additives, and this is preferable under many circumstances. Examples of suitable gaseous additives include nitrogen, steam, carbon monoxide, carbon dioxide, ammonia, methane, air, ethane, propane, butane, and other hydrocarbon compounds in the gaseous state at the pretreatment temperature.

When these additives are employed, it is preferable that they be employed in an amount of at least about 1.2, more preferably at least about 12, and most preferably at least about 120 cubic meters per hour per metric ton of coal being processed.

A particularly preferred additive is steam. Heat pretreatment with steam is preferably conducted within a temperature range of from about 100° C. to about 300° C., more preferably from about 150° C. to about 250° C., and most preferably from about 175° C. to about 225° C. Preferably the pretreatment should be conducted for at least about 0.25 hours, more preferably for at least about 0.5 hours, and most preferably for at least one hour. The amount of water preferably ranges from about 2% to about 50%, more preferably from about 5% to about 30%, and most preferably from about 10% to about 25%, based on the weight of the coal being treated.

One particularly preferred technique for performing the pretreatment process of the invention is to conduct the process while the coal is in a fluidized state. Conventional fluidized bed apparati and processes are suitable. This fluidized treatment facilitates thorough pretreatment of all of the coal.

EXAMPLES

In all the examples given, the chemically treated coal sample was separated in a magnetic separator to give a non-magnetic clean coal fraction and a magnetic refuse fraction.

EXAMPLE 1

A sample of Illinois No. 6 coal was dry screened and 75 grams of the 14 × 150 mesh material was roasted at a temperature of 190°–195° C. for 12 minutes and treated with iron pentacarbonyl in an amount of 7.5 kilograms per metric ton of coal, the carbonyl being carried in a nitrogen atmosphere. A batch of the identical coal was pre-treated by heating it to 200° C. with moist air passing through the reactor for 15 minutes followed by dry air for five minutes, and was then given an identical iron carbonyl treatment. Both samples were subjected to magnetic separation, resulting in the analyses set forth in Table 1.

Table 1

| | Coal, No Pretreatment | | Pretreated Coal | |
|---|---|---|---|---|
| | | Clean | | Clean |
| | Feed | Coal | Feed | Coal |
| Ash (%) | 30.4 | 15.5 | 31.4 | 12.2 |
| Pyritic Sulfur (%) | 3.89 | 3.90 | 4.03 | 2.37 |
| Yield (%) | — | 64.0 | — | 59.3 |

EXAMPLE 2

A sample of Illinois coal as in Example 1 was treated at 190°–195° C. for 30 minutes with 7.5 kilograms per metric ton of iron pentacarbonyl carried in a nitrogen atmosphere. An identical sample was similarly treated; however, the coal was pretreated at 190°–195° C. for 30 minutes with a gas comprising nitrogen at 200 cubic meters per hour per metric ton and water vapor at 21 kilograms per hour per metric ton. As Table 2 indicates, following magnetic separation, the pretreated coal obtained a greater reduction of both ash and pyritic sulfur.

Table 2

| | Coal, No Pretreatment | | Pretreated Coal | |
|---|---|---|---|---|
| | Feed | Clean Coal | Feed | Clean Coal |
| Ash (%) | 29.2 | 12.2 | 29.4 | 11.2 |
| Pyritic Sulfur (%) | 3.69 | 4.48 | 3.63 | 2.87 |
| Yield (%) | — | 56.5 | — | 56.9 |

EXAMPLE 3

The treating of 75 grams of Lower Freeport coal with 16 kilograms per metric ton of iron pentacarbonyl at 170° C. for one hour with a nitrogen purge of 250 milliliters per minute during heat-up and cool-down resulted in a product yield of 56.9% containing 22.5% ash and 1.85% pyritic sulfur. Pretreatment of the Lower Freeport coal with heat and/or steam under various reaction conditions followed by the same carbonyl treatment described above resulted in greater reductions of both ash and pyritic sulfur in the clean coal. The raw coal in all samples was sized to 14-mesh × 0. The pretreatment conditions and clean coal analyses are given in Table 3 below.

Table 3

| | Variable Conditions | | | | Results | | |
|---|---|---|---|---|---|---|---|
| | Pretreatment | | | | Clean Coal Product | | |
| Sample Number | Water, ml/min | Temp, ° C | Time, min | Steam Conc., % Atmos. | Yield Wt. % | Ash, % | Pyritic S, % |
| No Pretreatment | — | — | — | — | 56.9 | 22.5 | 1.85 |
| 1 | — | 190 | 10 | 0 | 54.5 | 11.2 | 1.13 |
| 2 | 0.95 | 190 | 10 | 25 | 52.6 | 13.1 | 1.45 |
| 3 | 3.35 | 190 | 10 | 89 | 55.8 | 10.6 | 0.84 |
| 4 | 0 | 260 | 10 | 0 | 71.4 | 13.5 | 1.23 |
| 5 | 0.95 | 260 | 10 | 28 | 69.7 | 13.9 | 1.02 |
| 6 | 3.35 | 260 | 10 | 98 | 81.2 | 18.7 | 0.84 |
| 7 | 0 | 190 | 30 | 0 | 73.9 | 15.7 | 0.59 |
| 8 | 0.95 | 190 | 30 | 25 | 68.3 | 12.0 | 0.53 |
| 9 | 3.35 | 190 | 30 | 89 | 68.1 | 11.5 | 0.37 |
| 10 | 0 | 260 | 30 | 0 | 65.6 | 18.6 | 1.27 |
| 11 | 0.95 | 260 | 30 | 28 | 75.3 | 14.8 | 0.77 |
| 12 | 3.35 | 260 | 30 | 98 | 78.6 | 16.4 | 0.58 |
| Raw Coal | — | — | — | — | — | 28.1 | 1.76 |

EXAMPLE 4

The effects of adding various gases during the preconditioning steam treatment on the results of the iron carbonyl process on Lower Freeport coal are presented in Table 4. The conditions common to each test consisted of a charge of 75 grams of Lower Freeport coal, mesh size 14 × 0, heated to 200° C. for 60 minutes (including heat-up and cool-down in 250 milliliters per minute of $N_2$) with water vapor introduced during the run at 0.46 grams per minute. As indicated in Table 4, various gases were added during the steam pretreatment. The carbonyl treatment for all tests was conducted at a temperature of 170° C. for one hour with 16 kilograms per metric ton of iron pentacarbonyl.

Table 4

| Sample | No Pretreatment | 1 | 2 | | 3 | | 4 | | 5 | | 6 | | 7 | 8 | |
|---|---|---|---|---|---|---|---|---|---|---|---|---|---|---|---|
| Conditions: | | | | | | | | | | | | | | | |
| Gas | — | $N_2$ | CO | $N_2$ | $CO_2$ | $N_2$ | Air | $N_2$ | $NH_3$ | $N_2$ | $SO_2$ | $N_2$ | $N_2$ | Butane | $N_2$ |
| Flow, ml/min | — | 150 | 50 | 100 | 27 | 123 | 150 | 150 | 50 | 100 | 50 | 100 | 150 | 50 | 100 |
| Time, minutes | — | 1–60 | 1–60 | 1–60 | 1–60 | 1–60 | 1–30 | 31–60 | 1–60 | 1–60 | 1–60 | 1–60 | 1–60 | 1–60 | 1–60 |
| Yield, Weight % | | | | | | | | | | | | | | | |
| Clean Coal | 56.9 | 69.6 | 77.4 | | 72.3 | | 73.9 | | 89.8 | | 61.3 | | 61.2 | 61.8 | |

Table 4-continued

| Sample | No Pretreatment | 1 | 2 | 3 | 4 | 5 | 6 | 7 | 8 |
|---|---|---|---|---|---|---|---|---|---|
| Ash, % | | | | | | | | | |
| Clean Coal | 22.5 | 13.3 | 17.7 | 15.9 | 15.3 | 25.1 | 11.9 | 15.3 | 9.6 |
| Pyritic S, % | | | | | | | | | |
| Clean Coal | 1.85 | 0.40 | 0.52 | 0.47 | 0.42 | 1.0 | 0.57 | 0.44 | 0.31 |

The feed coal contained 29.9% ash and 1.63% pyritic sulfur.

EXAMPLE 5

Both steam (derived from 192 kilograms of water per metric ton of coal and injected over a one-hour period into a chamber of coal at 200° C.) and heat (at 130° C. for 30 minutes with $N_2$ flow at 1.7 liters per minute) pretreated Lower Freeport coal, size 14 × 0 — mesh, were treated with various organic iron containing compounds as shown in Table 5. The coal was heated stepwise to the indicated temperatures and the iron compound, which was vaporized externally, was injected as vapor into the reaction chamber. The ferric acetylacetonate was dissolved in acetone and mixed with the coal, followed by drying in a stream of nitrogen. The coal was then heated stepwise to operating temperature with the temperature being increased slowly to the indicated temperatures.

EXAMPLE 6

Three identical samples of Pittsburgh coal, 14 × 0 mesh, containing 17.9% ash and 1.67% pyritic sulfur, were treated with 8 kilograms per metric ton of iron pentacarbonyl at a temperature of 190°-195° C. for 60 minutes. The first, Sample 1, was given no pretreatment. The second, Sample 2, was pretreated with steam at 95 kilograms per metric ton at a temperature of 190°-195° C. for 60 minutes. The coal in Sample 3 was pretreated with steam at 95 kilograms per metric ton at a temperature of 250°-255° C. for 60 minutes. All the samples were given the same iron pentacarbonyl treatment. The coal pretreated with steam obtained greater reductions in both ash and pyritic sulfur content as shown in Table 6 below.

Table 6

| Sample | Pretreatment | Yield, Wt. % | Ash, % | Pyritic Sulfur, % |
|---|---|---|---|---|
| 1 | None | 84.6 | 10.8 | 1.09 |
| 2 | Steam (190-195° C) | 84.0 | 9.0 | 0.83 |
| 3 | Steam (250-255° C) | 86.5 | 10.0 | 0.93 |

EXAMPLE 7

A Lower Freeport bituminous coal from Pennsylvania was sized to 14 × 0 mesh and samples were treated for 60 minutes with 16 kilograms of iron pentacarbonyl per metric ton of coal at a temperature of about 170° C. Sample 1 was not initially pretreated; runs 2 through 13 were each 125 gram samples of coal which were dried at various temperatures for various times in a large forced-air oven in 19 × 19 × 4.5 centimeter metal pans. The dried samples were stored in a nitrogen atmosphere until carbonyl treated. The temperature and time of these pretreatments are given in Table 7.

EXAMPLE 8

A sample of Illinois No. 6 coal was wet with water and then dried in a fluid bed reactor with synthetic flue gas consisting of about 5.5% $O_2$, 12.9% $CO_2$, and 81.6% $N_2$ for 15 minutes at a temperature of 305° C. The sample was treated (after a two year interval during which it was stored under nitrogen to prevent deterioration) for 60 minutes with 16 kilograms per metric ton of iron pentacarbonyl at a temperature of 170° C. Following magnetic separation, the clean coal represented 78.8% of the starting material, with an ash content of 17.1% and a pyritic sulfur content of 1.33%. The feed coal has an ash content of 30.4% and a pyritic sulfur content of 3.89%, and this coal does not meaningfully respond to iron carbonyl treatment with respect to pyrite removal in the absence of a pretreatment.

TABLE 7

| Variable Conditions of Pretreatment | | | Results Clean Coal Product | | |
|---|---|---|---|---|---|
| Sample Number | Temp, ° C | Time, Hours | Yield, Wt.% | Ash % | Pyritic S,% |
| 1 | — | — | 56.9 | 22.5 | 1.85 |
| 2 | 123 | 2 | 69.6 | 23.6 | 1.67 |
| 3 | 178 | 2 | 77.8 | 16.8 | 0.63 |
| 4 | 225 | 2 | 89.2 | 23.9 | 0.57 |
| 5 | 123 | 8 | 66.3 | 24.2 | 1.74 |
| 6 | 178 | 8 | 84.3 | 18.6 | 0.60 |
| 7 | 225 | 8 | 86.7 | 22.0 | 0.72 |
| 8 | 123 | 16 | 60.1 | 19.3 | 1.39 |
| 9 | 178 | 16 | 87.9 | 20.8 | 0.56 |
| 10 | 180 | 16 | 85.5 | 16.6 | 0.59 |
| 11 | 225 | 16 | 88.6 | 23.5 | 0.68 |

Table 5

| Compound | Conditions: Maximum Temp, ° C | Kg/metric ton | Time at Max.Temp, hr | | Sample | Clean Coal Analysis: Yield, Wt% | Ash, % | Inorganic Sulfur, % |
|---|---|---|---|---|---|---|---|---|
| Ferrocene | 275 | 16 | 1 | 1 | steamed | 74.1 | 23.8 | 1.41 |
| | 275 | 16.2 | 1 | 2 | dried | 69.5 | 24.1 | 1.75 |
| Ferrocene carboxylic acid | 275 | 7.9 | 1 | 3 | steamed | 81.0 | 25.3 | 1.47 |
| | 275 | 9.7 | 1 | 4 | dried | 74.0 | 23.6 | 1.56 |
| Acetylferrocene | 275 | 13 | 1 | 5 | steamed | 77.2 | 22.7 | 1.41 |
| | 275 | 16.4 | 1 | 6 | dried | 70.5 | 24.3 | 1.82 |
| Dimethyl ferrocenedioate | 275 | 15 | 1 | 7 | steamed | 79.1 | 24.0 | 1.46 |
| | 275 | 15.6 | 1 | 8 | dried | 67.8 | 24.2 | 1.49 |
| Ferric acetylacetonate | 285 | 16 | 0.33 | 9 | steamed | 75.1 | 22.4 | 1.31 |
| | 285 | 16.1 | 0.33 | 10 | dried | 75.3 | 22.7 | 1.64 |
| Feed (untreated) | — | — | — | — | | 100 | 28.1 | 1.76 |

TABLE 7-continued

| Variable Conditions of Pretreatment | | | Results Clean Coal Product | | |
|---|---|---|---|---|---|
| Sample Number | Temp, ° C | Time, Hours | Yield, Wt.% | Ash % | Pyritic S,% |
| 12 | 123 | 48 | 59.1 | 16.5 | 1.04 |
| 13 | 178 | 48 | 88.5 | 22.3 | 0.63 |
| 14 | 225 | 48 | 87.5 | 23.0 | 0.72 |

What is claimed is:

1. In a process for improving coal wherein raw coal is treated with a metal containing compound in order to enhance the magnetic susceptibility of one or more impurities susceptible to the metal containing compound treatment, thereby permitting the removal of these impurities by magnetic separation, the improvement comprising:

pretreating the coal by heating it to at least a temperature for at least a period of time sufficient to essentially meet or exceed a time and temperature relationship expressed as:

$$D \geqq K(50/T-90)^3$$

wherein $D$ is time in hours and $T$ is temperature in degrees Celsius and is not less than about 95° C., and wherein $K$ is at least about 0.5.

2. The process of claim 1 wherein the said metal containing compound is an organic iron containing compound.

3. The process of claim 2 wherein the said organic iron containing compound is capable of exerting sufficient vapor pressure, with iron as a component in the vapor, so as to bring the iron into contact with the impurity at the reaction temperature.

4. The process of claim 3 wherein the said organic iron containing compound is selected from the group consisting of ferrocene, ferrocene derivatives, and beta-diketone compounds of iron.

5. The process of claim 4 wherein the said organic iron containing compound is one or more members selected from the group consisting of ferrocene, dimethyl ferrocenedioate, 1,1'-ferrocenedicarboxylic acid, ferric acetylacetonate, and ferrous acetylacetonate.

6. The process of claim 1 wherein said metal containing compound is an inorganic iron containing compound.

7. The process of claim 1 wherein said metal containing compound comprises one or more members selected from the group consisting of iron carbonyl, nickel carbonyl, cobalt carbonyl, molybdenum carbonyl, tungsten carbonyl, and chromium carbonyl.

8. The process of claim 1 wherein said metal containing compound comprises iron carbonyl.

9. The process of claim 8 wherein said iron carbonyl is iron pentacarbonyl.

10. The process of claim 9 wherein the iron pentacarbonyl treatment is conducted within a temperature range of from about 150° C. to about 200° C. for a period of time of from about one-half to about four hours.

11. The process of claim 1 wherein K is at least about 5.

12. The process of claim 1 wherein K is at least about 25.

13. The process of claim 1 wherein the pretreatment is performed at a temperature of at least 150° C.

14. The process of claim 1 wherein the pretreatment is performed at a temperature of at least 170° C.

15. The process of claim 1 wherein the duration of the pretreatment is at least 1 hour.

16. The process of claim 1 wherein the duration of the pretreatment is at least 2 hours.

17. The process of claim 1 wherein the pretreatment is conducted in the presence of one or more gaseous additives.

18. The process of claim 17 wherein the said gaseous additives are selected from the group consisting of nitrogen, steam, carbon monoxide, carbon dioxide, ammonia, methane, air, ethane, propane, and butane.

19. The process of claim 17 wherein the gaseous additive is steam.

20. The process of claim 17 wherein the said gaseous additive is a hydrocarbon compound in the gaseous state at the pretreatment temperature.

21. The process of claim 17 wherein the said gaseous additives are employed in an amount of at least 1.2 cubic meters per hour per metric ton of coal being processed.

22. The process of claim 2 wherein the said organic iron containing compound has a solubility of at least about 1 gram per liter at the pretreatment temperature.

23. The process of claim 22 wherein the said compound has a solubility of at least 10 grams per liter at injection temperature.

24. The process of claim 22 wherein the solvent for the organic iron containing compound is one or more members selected from the group consisting of acetone, petroleum ether, naphtha, hexane, and benzene.

25. The process of claim 1 wherein the impurities comprise pyrite and ash-forming minerals.

26. The process of claim 25 wherein the impurity comprises ash-forming minerals.

27. The process of claim 25 wherein the impurity comprises pyrite.

28. In a process for improving coal wherein raw coal is treated with iron carbonyl in order to enhance the magnetic susceptibility of one or more impurities, thereby permitting the removal of these impurities by magnetic separation, the improvement comprising:

pretreating the coal by heating it to at least a temperature for at least a period of time sufficient to essentially meet or exceed a time and temperature relationship expressed as:

$$D \geqq K(50/T-90)^3$$

wherein D is time in hours and T is temperature in degrees Celsius and is not less than about 95° C., and wherein K is at least about 0.5.

29. The process of claim 28 wherein K is at least about 5.

30. The process of claim 28 wherein K is at least about 25.

31. The process of claim 28 wherein the pretreatment is performed at a temperature of at least 150° C.

32. The process of claim 28 wherein the pretreatment is performed at a temperature of at least 170° C.

33. The process of claim 28 wherein the duration of the pretreatment is at least 1 hour.

34. The process of claim 28 wherein the duration of the pretreatment is at least 2 hours.

35. The process of claim 28 wherein the pretreatment is conducted in the presence of one or more gaseous additives.

36. The process of claim 35 wherein the said gaseous additives are selected from the group consisting of nitrogen, steam, carbon monoxide, carbon dioxide, ammonia, methane, air, ethane, propane, and butane.

37. The process of claim 35 wherein the gaseous additive is steam.

38. The process of claim 35 wherein the said gaseous additive is a hydrocarbon compound in the gaseous state at the pretreatment temperature.

39. The process of claim 35 wherein the said gaseous additives are employed in an amount of at least 1.2 cubic meters per hour per metric ton of coal being processed.

40. The process of claim 28 wherein the impurities comprise pyrite and ash-forming minerals.

41. The process of claim 40 wherein the impurity comprises pyrite.

42. The process of claim 40 wherein the impurity comprises ash-forming minerals.

* * * * *

UNITED STATES PATENT AND TRADEMARK OFFICE

CERTIFICATE OF CORRECTION

PATENT NO. : 4,120,665

DATED : October 17, 1978

INVENTOR(S) : James K. Kindig and Ronald L. Turner

It is certified that error appears in the above-identified patent and that said Letters Patent are hereby corrected as shown below:

In the Abstract, paragraph 1, "$D \geqq K(50/T-90)^3$", should be --$D \geq K\left(\frac{50}{T-90}\right)^3$--.

Column 2, line 58, "$D \geqq K(50/T-90)^3$", should be --$D \geq K\left(\frac{50}{T-90}\right)^3$--.

Column 3, line 16, "of", should be --or--.

Column 5, line 64, "$D \geqq K(50/T-90)^3$", should be --$D \geq K\left(\frac{50}{T-90}\right)^3$--.

Column 11, line 23, "$D \geqq K(50/T-90)^3$", should be --$D \geq K\left(\frac{50}{T-90}\right)^3$--.

Column 12, line 49, "$D \geqq K(50/T-90)^3$", should be --$D \geq K\left(\frac{50}{T-90}\right)^3$--.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*